US009662656B2

(12) United States Patent
Jackson

(10) Patent No.: US 9,662,656 B2
(45) Date of Patent: May 30, 2017

(54) SLUG BAR FOR TUB GRINDERS

(71) Applicant: JASE Corporation, Weldon, IA (US)

(72) Inventor: Richard A. Jackson, Weldon, IA (US)

(73) Assignee: JASE Corporation, Weldon, IA (US)

( * ) Notice: Subject to any disclaimer, the term of this patent is extended or adjusted under 35 U.S.C. 154(b) by 550 days.

(21) Appl. No.: 14/102,946

(22) Filed: Dec. 11, 2013

(65) Prior Publication Data

US 2014/0110515 A1 Apr. 24, 2014

Related U.S. Application Data

(63) Continuation of application No. 13/452,554, filed on Apr. 20, 2012, now Pat. No. 8,628,036.

(51) Int. Cl.

| | |
|---|---|
| ***B02C 13/00*** | (2006.01) |
| ***B02C 13/28*** | (2006.01) |
| ***B02C 13/04*** | (2006.01) |
| ***B02C 18/06*** | (2006.01) |

(52) U.S. Cl.

CPC ..... *B02C 13/2804* (2013.01); *B02C 13/04* (2013.01); *B02C 18/067* (2013.01)

(58) Field of Classification Search

CPC .... B02C 13/2804; B02C 18/067; B02C 13/04

USPC ..... 241/101.76, 195, 186.4

See application file for complete search history.

(56) References Cited

U.S. PATENT DOCUMENTS

| | | | | | |
|---|---|---|---|---|---|
| 2,171,463 | A * | 8/1939 | Tschauner | B02C 13/282 | 241/190 |
| 3,912,175 | A | 10/1975 | Anderson | | |
| 3,966,128 | A | 6/1976 | Anderson | | |
| 4,033,515 | A | 7/1977 | Barcell | | |
| 4,066,216 | A | 1/1978 | Waldrop | | |
| 4,106,706 | A * | 8/1978 | Burrows | B02C 13/04 | 241/101.761 |
| 4,134,554 | A | 1/1979 | Morlock | | |
| 4,210,289 | A | 7/1980 | Arnoldy | | |
| 4,364,526 | A * | 12/1982 | White | A01F 29/005 | 241/101.761 |
| 4,412,659 | A * | 11/1983 | Crawford | B02C 13/286 | 241/186.2 |
| 4,693,426 | A * | 9/1987 | White | A01F 29/005 | 241/18 |
| 4,773,601 | A | 9/1988 | Urich | | |
| 4,846,411 | A | 7/1989 | Herron | | |
| 5,207,391 | A | 5/1993 | Anderson | | |
| 5,419,502 | A | 5/1995 | Morey | | |
| 5,626,298 | A | 5/1997 | Arnoldy | | |
| 5,878,968 | A | 3/1999 | Anderson | | |
| 6,109,553 | A * | 8/2000 | Hruska | A01F 29/005 | 241/189.1 |
| 6,202,950 | B1 * | 3/2001 | Hruska | A01F 29/005 | 241/101.762 |

(Continued)

*Primary Examiner* — Faye Francis

(74) *Attorney, Agent, or Firm* — McKee, Voorhees & Sease, PLC

(57) ABSTRACT

A tub grinder has a rotor with hammers that pass between adjacent slug bars. The slug bars have a riser bar portion disposed on the top of the slug bars, the riser bar portions extending vertically higher on one end of each respective slug bar than on the other end of each respective slug bar so that the hammers extend farther beyond the top of the riser bar and slug bar when they pass by first end than when they pass by the second end of the riser bar.

5 Claims, 6 Drawing Sheets

(56) References Cited

U.S. PATENT DOCUMENTS

| | | | | |
|---|---|---|---|---|
| 6,412,715 | B1 | 7/2002 | Brand | |
| 7,871,028 | B2 * | 1/2011 | Marschall | A01F 29/005 241/101.761 |

* cited by examiner

EASY

SLUG BAR FOR TUB GRINDERS

CROSS REFERENCE TO RELATED APPLICATIONS

This application is a continuation of U.S. patent application Ser. No. 13/452,554 filed Apr. 20, 2012, and is incorporated by reference herein in its entirety.

TECHNICAL FIELD

This invention relates generally to tub grinders and more particularly to an improvement to the slug bars of tub grinders.

BACKGROUND

Grinders for grinding hay or other materials to be ground are shown in U.S. Pat. No. 3,912,175 to Anderson, U.S. Pat. No. 3,966,128 to Anderson et al., U.S. Pat. No. 4,033,515 to Barcell et al., U.S. Pat. No. 4,134,554 to Morlock, U.S. Pat. No. 4,210,289 to Arnoldy, U.S. Pat. No. 4,846,411 to Herron et al., U.S. Pat. No. 5,419,502 to Morey, U.S. Pat. No. 5,626,298 to Arnoldy, and U.S. Pat. No. 6,412,715 to Brand et al., all of which are incorporated herein by reference in their entirety.

Tub grinders are used to reduce the size of many things such as bales of hay, tree branches, material from demolished buildings, etc. The material is placed in the top of the "tub" portion, for example with a grappling hook or front end loader on a tractor, then the tub portion rotates around a floor as can be seen in the prior art shown in FIG. 1 of the drawings. An opening in the floor as shown in prior art FIGS. 1 and 2 is provided with rotating hammers passing between slug bars, the hammers hitting the material in the tub, reducing the size to smaller particles that are delivered to an unloading conveyor to put the ground up particles in a pile or on a trailer or the like for transporting the ground material to another place. Typically the material to be ground is moving in the direction of the tub as shown by the arrow in FIG. 1, while the hammers are rotating in the direction shown in FIG. 1.

One of the problems associated with tub grinders is that they do not operate at optimum efficiency for all types of material to be ground.

Accordingly a tub grinder that can be easily adapted to efficiently grind different types of material is needed.

BRIEF DESCRIPTION OF THE DRAWINGS

The above needs are at least partially met through provision of the apparatus described in the following detailed description, particularly when studied in conjunction with the drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
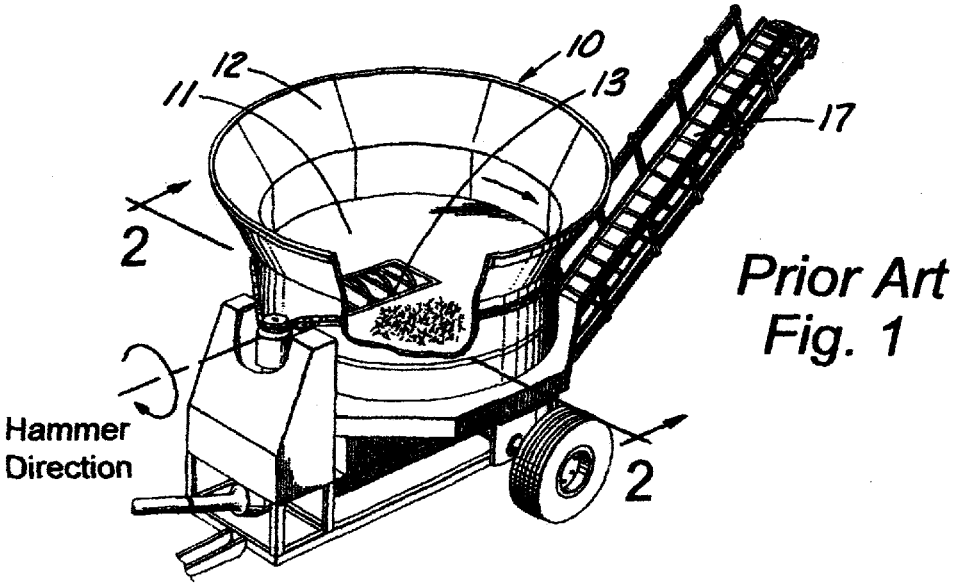
Prior Art Fig. 1
FIG. 1 is a typical prior art tub grinder.
Figure 2:
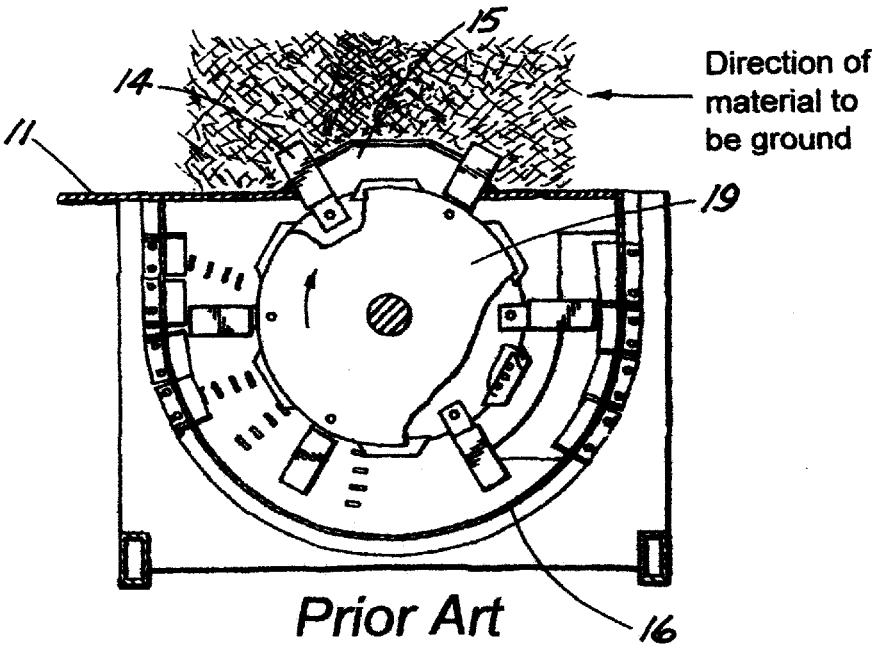
Prior Art Fig. 2
FIG. 2 is a cross sectional view taken along line 2-2 of the prior art device of FIG. 1.

Referring now to the drawings, wherein like reference numerals indicate identical or similar parts throughout the several views, FIGS. 1 and 2 show a typical tub grinder 10 without the improvements of the present invention thereon and explained in the third paragraph above. The tub grinder 10 has a floor 11 that is fixed with respect to the frame of the tub grinder 10. A rotating wall 12 is provided for moving the material within the walls of the tub wall 12 in the same general direction that the tub wall 12 is moving in order to move the material to a hammer mill 13 disposed in an opening in the floor of the tub grinder 10. Rotation of the rotor 19 and hammers 14 in the direction shown in FIG. 2 between slug bars 15 forces material above the floor 11 down into the area above screen 16 and the hammers also force the material through the screen 16 so that the ground up material can eventually be delivered to the unloading conveyor 17 for dumping the ground up material on the ground or into a trailer or wagon or the like.

Figure 3A:
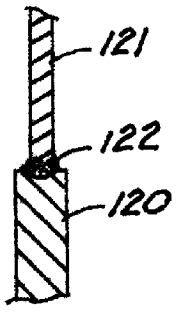
FIG. 3A is an enlarged, partial cross sectional view taken along line 3A-3A of FIG. 3.
Figure 3:
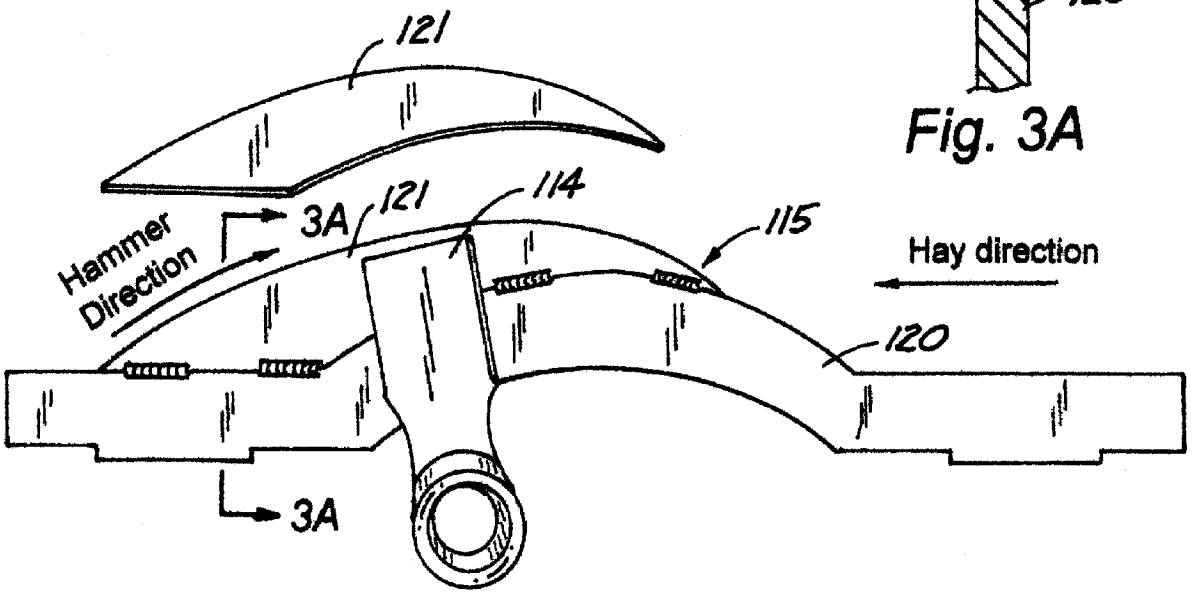
FIG. 3 is a side elevational view of a slug bar with one preferred configuration of a riser bar welded to the top thereof and immediately above that integral structure is shown the riser bar alone, before it is welded onto the slug bar.

FIG. 3 is a side elevational view of a slug bar 115 with one preferred configuration of a riser bar 121 welded by welds 122 to the top of prior art part 120 thereof as shown in FIG. 3A, and immediately above that integral slug bar structure 115 in FIG. 3 is shown the riser bar 121 alone, before it is welded onto the prior art slug bar 120.

Figure 4A:
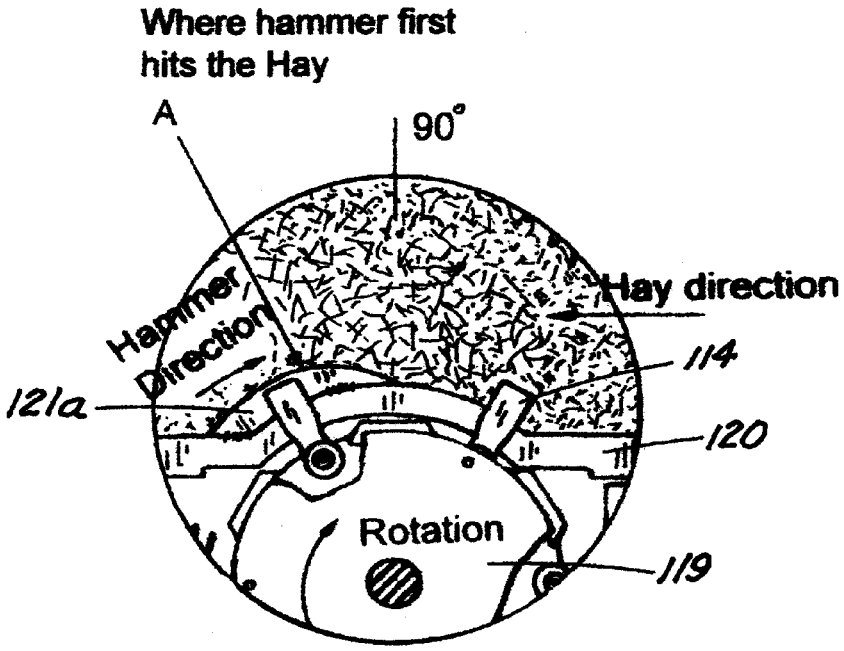
FIG. 4A is a cross sectional view similar to the prior art view of FIG. 2, but showing a preferred embodiment of the present invention set up for grinding material that is relatively easy to grind.

FIG. 4A is a cross sectional view similar to the prior art view of FIG. 2, but showing a preferred embodiment of the present invention set up for grinding material that is relatively easy to grind, such as very dry or light porous material such as alfalfa hay or Styrofoam. The rotor 119 is rotated in the direction shown by the arrow in FIG. 4A and the swinging hammers 114 do not hit the material to be ground as the hammers 114 first rotate upwardly between the slug bars 120 and riser bar portions 121*a* until about point A on the riser bar portion 121*a*. After that the hammers 114 gradually extend above the riser bar portions 121*a* more until they are only extending above the slug bars 120.

Figure 4B:
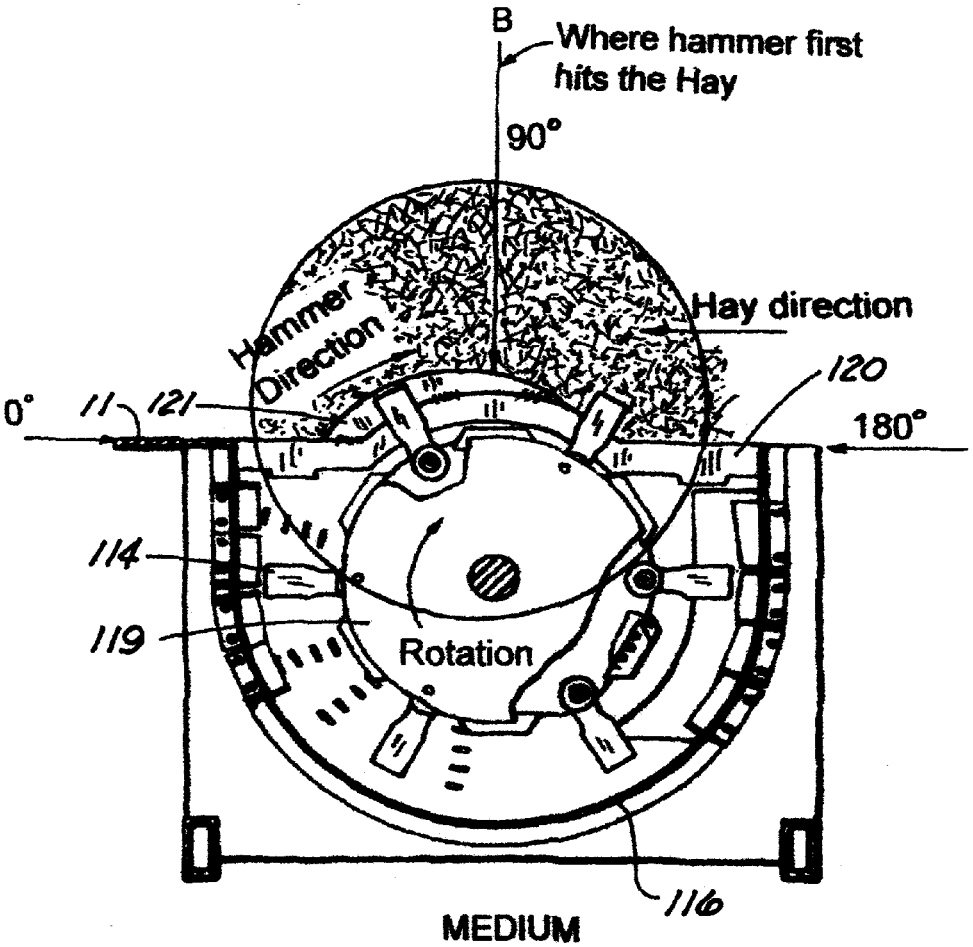
FIG. 4B is a cross sectional view similar to the prior art view of FIG. 2, but showing a preferred embodiment of the present invention set up for grinding material that is more usual or medium to grind.

FIG. 4B is a cross sectional view similar to the view of FIG. 4A, but showing a preferred embodiment of the present invention set up for grinding material that is average or medium to grind, such as wet or dense material like high moisture hay or fescue hay or medium porous material or the like. The rotor 119 is rotated in the direction shown by the arrow in FIG. 4B and the swinging hammers 114 do not hit the material to be ground as the hammers 114 first rotate upwardly between the slug bars 120 and riser bar portions 121 until about point B on the riser bar portion 121. After that the hammers 114 gradually extend above the riser bar portions 121*a* more until they are only extending above the slug bars 120. Since the riser bar portion 121 is longer an higher for more of the length of the riser bar 121 than for the riser bar portion 121*a* in FIG. 4A, the hammers 114 only extend above the riser bar portions 121 starting at point B where the hammer is substantially vertically oriented, therefore since the hammers 114 extend above the riser bars for less time and do not extend above the riser bars as far during such relative time, a less aggressive approach is taken which requires less horsepower to rotate the rotor 119 and doesn't slow the revolutions per minute (rpm) as much as if the same medium to grind material was in the tub grinder arrangement shown in FIG. 4A. Keeping the rpm of the rotor 119 (and therefore the rpm of an engine that rotates the rotor 119) above a certain predetermined level is important to the efficiency of a tub grinder and also reduces the wear and tear on such equipment such as the engine powering the tub grinder. The hammers 114 force the material through a screen 116 similar to FIG. 2.

Figure 4C:
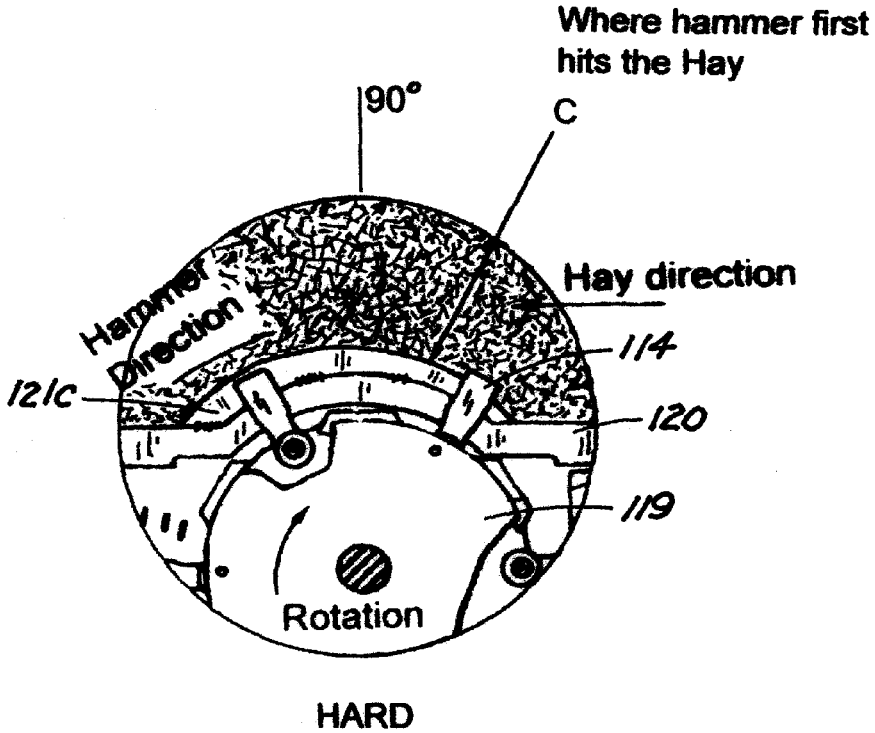
FIG. 4C is a cross sectional view similar to the prior art view of FIG. 2, but showing a preferred embodiment of the present invention set up for grinding material that is difficult or hard to grind.

FIG. 4C is a cross sectional view similar to the view of FIGS. 4A and 4B, but showing a preferred embodiment of the present invention set up for grinding material that is difficult or hard to grind, such as very dense material like wood, rubber, rubber tires or the like. The rotor 119 is rotated in the direction shown by the arrow in FIG. 4C and the swinging hammers 114 do not hit the material to be ground as the hammers 114 first rotate upwardly between the slug bars 120 and riser bar portions 121*c* until about point C on the riser bar portion 121*c*. After that the hammers 114 gradually extend above the riser bar portions 121*c* more until they are only extending above the slug bars 120. Since the riser bar portion 121*c* is longer an higher for more of the length of the riser bar 121*c* than for the riser bar portion 121*a* in FIG. 4A or riser bar portion 121 of FIG. 4B, the hammers 114 only extend above the riser bar portions 121 starting at point C where the hammer 114 is substantially past vertically oriented, therefore since the hammers 114 extend above the riser bars 121*c* for less time than when riser bars 121 or 121*a* are used and do not extend above the riser bars 121*c* as far during such relative time, a less aggressive approach is being taken than when the riser bars 121 or 121*a* are used, which requires less horsepower to rotate the rotor 119 and doesn't slow the revolutions per minute (rpm) as much as if the same easy to grind or medium to grind material was in the tub grinder arrangement shown in FIG. 4A or FIG. 4B respectively.

Figure 5:
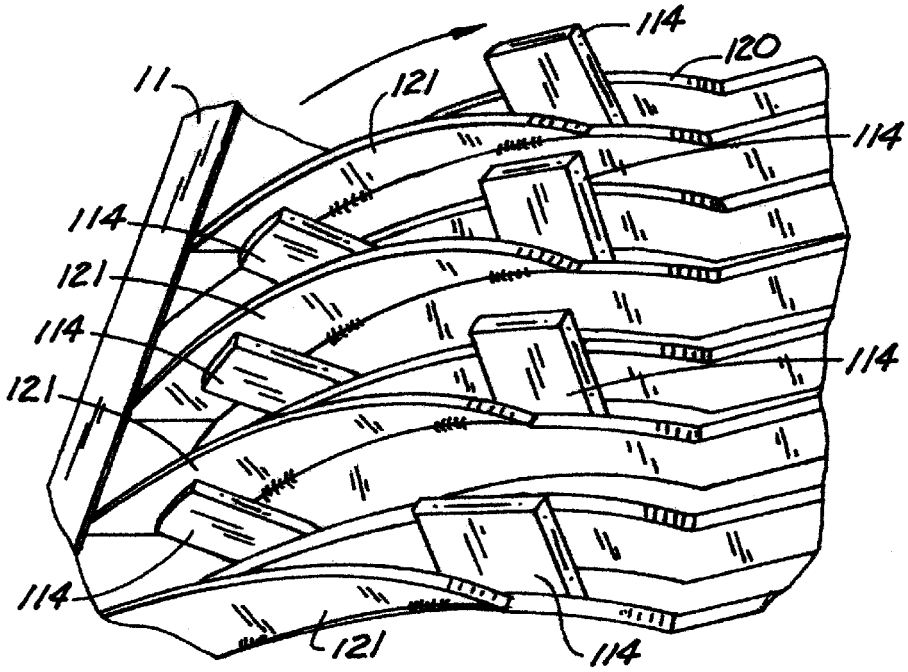
FIG. 5 is a perspective view of the embodiment of FIGS. 3 and 4B as would be seen if looking at a tub grinder from the view of FIG. 1 if it had the improvement of the present invention thereon.

FIG. 5 is a perspective view of the embodiment of FIGS. 3 and 4B as would be seen if looking at a tub grinder 10 from the view of FIG. 1 if it had the improvement of the present invention thereon. Slug bars 120 have riser bar portions 121 welded to the top thereof and the hammers 114 are shown passing between the slug bars 120 and riser bar portions 121 to gradually begin grinding material as the hammers 114 move to the right in the direction of the arrow shown in FIG. 5.

Figure 6:
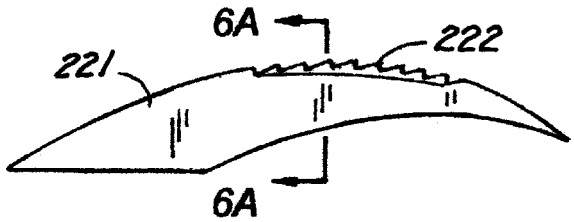
FIG. 6 is a side elevational view of a riser bar similar to the one shown in FIG. 3, but having a serrated and sharpened top surface on a part thereof.
Figure 6A:
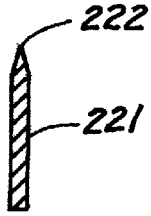
FIG. 6A is a cross sectional view taken along line 6A-6A of FIG. 6.

FIG. 6 is a side elevational view of a riser bar 221 similar to the riser bar 121 shown in FIG. 3, but having a serrated and sharpened top surface 222 on a part thereof. FIG. 6A is a cross sectional view taken along line 6A-6A of FIG. 6 and shows how the serrated part 222 is also sharpened to an edge. Using this alternate embodiment will provide additional cutting action as the hammers 114 force the material against the sharpened serrated edge 222.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

I claim:

1. Apparatus for use to form a portion of a grate in a tub grinder comprising:

a tub grinder, the tub grinder including:
- a floor including a grate; and
- a tub grinder rotor below the grate, wherein the tub grinder rotor includes an axis of rotation;

a slug bar secured to the tub grinder floor, the slug bar including:
- a bottom portion affixed to the tub grinder floor and having a bottom portion bottom surface;
- a top portion disposed above the tub grinder floor;

a riser bar secured to the top portion, the riser bar including:
- a central portion, wherein the central portion is directly above the tub grinder rotor axis of rotation;
- a first curved portion left of the central portion having a first curved portion top surface and a first curved portion leading edge;
- a second curved portion right of the central portion having a second portion top surface;
- a first maximum distance between the first curved portion top surface and the bottom portion bottom surface, the first maximum distance occurring away from the first curved portion leading edge;
- a second maximum distance between the second portion top surface and the bottom portion bottom surface; and
- wherein the first maximum distance is greater than the second maximum distance; and a hammer secured to the tub grinder rotor, the hammer having a plurality of positions when the tub grinder rotor is rotating, at least one of the plurality of positions extending above the riser bar.

2. The apparatus of claim 1 wherein the second portion top surface is curved.

3. The apparatus of claim 1 wherein the first portion top surface and the second portion top surface are curved.

4. Apparatus for use to form a portion of a grate in a tub grinder comprising:

a tub grinder, the tub grinder including:
- a floor including a grate; and
- a tub grinder rotor below the grate, wherein the tub grinder rotor includes an axis of rotation;

a slug bar secured to the tub grinder floor, the slug bar including:

a bottom portion affixed to the tub grinder floor and having a bottom portion bottom surface;

a top portion disposed above the tub grinder floor;

a riser bar portion, the riser bar portion including:

a central portion, wherein the central portion is directly above the tub grinder rotor axis of rotation;

a first curved portion left of the central portion having a first portion top surface;

a second curved portion right of the central portion having a second portion top surface;

a first maximum distance between the first portion top surface and the bottom portion bottom surface;

a second maximum distance between the second portion top surface and the bottom portion bottom surface; and wherein the second maximum distance is greater than the first maximum distance; and a hammer secured to the tub grinder rotor, the hammer having a plurality of positions when the tub grinder rotor is rotating, at least one of the plurality of positions extending above the riser bar portion.

5. A tub grinder comprising:

a frame a floor secured to the frame;

a rotating wall extending upward from the floor, the rotating wall rotating material to be ground in a first direction;

an opening in the floor;

a hammer mill contacting material through the opening, the hammer mill including:

a rotor having a rotor axis of rotation;

a plurality of hammers secured to the rotor; and a plurality of slug bars, at least one of the plurality of slug bars including a riser bar portion, the riser bar portion including a leading edge, a trailing edge, and a riser bar portion maximum height and wherein the riser bar portion maximum height is located in between the riser bar leading edge and the riser bar trailing edge;

wherein at least one of the plurality of hammers rotates parallel to and in between two of the plurality of slug bars in a second direction, the at least one of the plurality of hammers having a point of rotation about the rotor axis of rotation including a hammer vertical orientation position, wherein the at least one of the plurality of slug bars has a slug bar hammer vertical orientation height at the hammer vertical orientation position; and wherein the riser bar portion maximum height is offset from the slug bar hammer vertical orientation height.

* * * * *